US006200157B1

(12) United States Patent
Ams et al.

(10) Patent No.: US 6,200,157 B1
(45) Date of Patent: Mar. 13, 2001

(54) PLUG FOR CONNECTION OF AN ELECTRO-FLUIDIC CONVERTER

(75) Inventors: Felix Ams, Kaempfelbach; Stefan Wegehingel, Pforzheim, both of (DE)

(73) Assignee: Asco Joucomatic GmbH & Co., Oelbronn-Duerrn (DE)

( * ) Notice: Subject to any disclaimer, the term of this patent is extended or adjusted under 35 U.S.C. 154(b) by 0 days.

(21) Appl. No.: 09/296,728

(22) Filed: Apr. 22, 1999

(30) Foreign Application Priority Data

Apr. 22, 1998 (DE) ..... 198 17 695

(51) Int. Cl.[7] ..... H01R 4/24; H01R 4/26; H01R 11/20

(52) U.S. Cl. ..... 439/409; 439/410; 439/412; 439/413

(58) Field of Search ..... 439/409, 410, 439/413, 417, 418, 404, 412, 405

(56) References Cited

U.S. PATENT DOCUMENTS 5,722,852 * 3/1998 Miek ..... 439/417

FOREIGN PATENT DOCUMENTS

| | | |
|---|---|---|
| 40 20 791 C1 | 6/1991 | (DE) . |
| 40 37 353 C1 | 3/1992 | (DE) . |
| 93 05 574 | 7/1993 | (DE) . |
| 93 18 648 | 3/1994 | (DE) . |
| 44 00 114 A1 | 7/1994 | (DE) . |
| 43 05 608 A1 | 8/1994 | (DE) . |
| 196 32 691 A1 | 1/1998 | (DE) . |
| 0 606 048 A1 | 7/1994 | (EP) . |
| 0 664 402 A1 | 7/1995 | (EP) . |
| 2 693 516 | 1/1994 | (FR) . |
| 2 163 815 | 3/1986 | (GB) . |

* cited by examiner

*Primary Examiner*—Lincoln Donovan
*Assistant Examiner*—Kyung S. Lee
(74) *Attorney, Agent, or Firm*—Michael J. Striker

(57) ABSTRACT

A plug for connection of an electro-fluidic converter provided with electrical plug contacts projecting from a converter housing, the plug has a plug housing, electrical counter contacts to the plug contacts of the converter and accommodated in the plug housing, electrical connecting means for a multi-wired encased connecting cable and accommodated in the plug housing, connecting means for electrical or electronic joining of the connecting means with the counter contacts and accommodated in the plug housing, and a contacting device provided for connecting the connecting cable with the connecting means and arranged in the plug housing, the contacting device having a movable cable receiving part for insertion of a cable portion and a clamping lever acting on the cable receiving part for contact-producing pressing of the cable portion against the connecting means.

30 Claims, 3 Drawing Sheets

PLUG FOR CONNECTION OF AN ELECTRO-FLUIDIC CONVERTER

BACKGROUND OF THE INVENTION

The present invention relates to plugs for connection of an electro-fluidic converter.

Electro-fluidic converters such as electro-pneumatic and electro-hydraulic converters, which convert an electrical input value into a fluid, for example pneumatic or hydraulic output value, and provided for this purpose with fluid valves actuated by electro magnets or piezo valves, are widely used in industrial control technology for power tools. The number of the converters required for a power tool control is very high and correspondingly increases the installation expenses, since all converters must be connected individually and thereby all converters must be manually contacted to connect them through control conduits with a central control device.

A known control device with two electro-fluidic, for example electro-hydraulic or electro-pneumatic converters arranged in a converter housing is disclosed for example in the German patent document DE 196 32 691 A1. It has a contacting device formed on the converter housing. A conductor portion with a two-wire connecting cable which serves for a current supply and transmission of control signals is inserted in a housing opening, and a clamping device is formed on a flappable housing cover. During pressing of the housing cover against the converter housing, a separating disk of the clamping device separates the connecting cable, and the pressing surfaces which press on the electrical conductors of both separated cable portions produce an electrical connection between the electrical conductors and the connecting contacts of an electric circuit. By means of this contacting unit, plurality of converters can be placed in a shortest time on the connecting cable and contacted.

SUMMARY OF THE INVENTION

Accordingly, it is an object of the present invention to provide a plug of the above mentioned type for connection of individual converters to a connecting cable which leads to a control unit, which is improved so that both the installation expense as well as the installation time for the device for the machine control can be reduced.

In keeping with these objects and with others which will become apparent herein after, one feature of present invention resides, briefly stated in a plug for connection of an electro-fluidic converter, in which the plug housing accommodates electrical counter contacts to converter plug contacts, electrical connecting means for a multi-wire, encased connecting cable, connecting means for electrical and electronic joining of the connecting means with the counter contacts, and a contacting device for connecting the connecting cable with the electrical connecting means, and the contacting device has a moveable cable receiving part for insertion of a cable portion as well as a clamping lever acting on the cable receiving part for producing contact of the cable portion against the connecting means.

The inventive plug for connection of an electro-fluidic converter has the advantage that the plug inside the plug housing is completely wired, and before or after the plugging on the plug contact of the converters without tools and fast it can provide the electrical connection to the connecting cable. For this purpose, the cable must be inserted in the movable cable receiving part and the clamping lever must be manually closed. The movability of the receiving part serves for an exact orientation of the cable without the danger of tilting during pressing of the clamping lever and guarantees in every place a reliable contacting of the connecting means with the cable wires. With closing of the clamping lever, the plug is connected both electrically to the connecting cable and also mechanically and in a spraying-water protected manner to the connecting cable. A mounting screw which is screwed on the converter housing passes through an opening in the plug housing. It serves for securing and prevents an unauthorized withdrawal or fall of the plug from the converter housing during or after the mounting, for example in the event of pull loading of the cable.

In accordance with a preferable embodiment of the invention, a centering projection cooperating with the clamping lever is provided on the cable receiving part. During turning on the cable receiving part the clamping lever is placed on the centering projection so that the clamping force produced by the clamping lever is transmitted centrally to the receiving part.

In accordance with a further preferable embodiment of the invention, the cable receiving part is arranged in a well formed in the plug housing. The electrical connecting means extend with the contact tips over the well bottom, and arresting openings are provided in the shaft well at a distance from the shaft bottom for engaging the arresting projections formed on the cable receiving part. The arresting connection formed by the arresting recesses and arresting projections is designed so that by the pressure force applied by the clamping lever on the cable receiving part the arresting projections exit the arresting recesses and the cable guiding part is released for displacement toward the well body. There the contact tips pass through corresponding throughgoing openings in the bottom of cable receiving part and extend in the cable so that the electrical conductors running in the cable are contacted.

In accordance with a further preferable embodiment of the invention, the contacting device has a separating disk for separation of the cable portion transversely to its extension. With the clamping lever acting on the cable receiving part, it passes through a slot formed in the bottom of the cable receiving part. This constructive design makes possible to contact with the one plug two converters integrated in one converter housing, or to separate the data input and the data output, and to connect the plug in a simple and time-saving manner to the connecting cable. Sealing contour surround each contact tip in the well base and provide in connection with the flexible cable installation a liquid-tight connection between the contact tips and the casing of the cable portion, so that no moisture can penetrate into the contact points.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
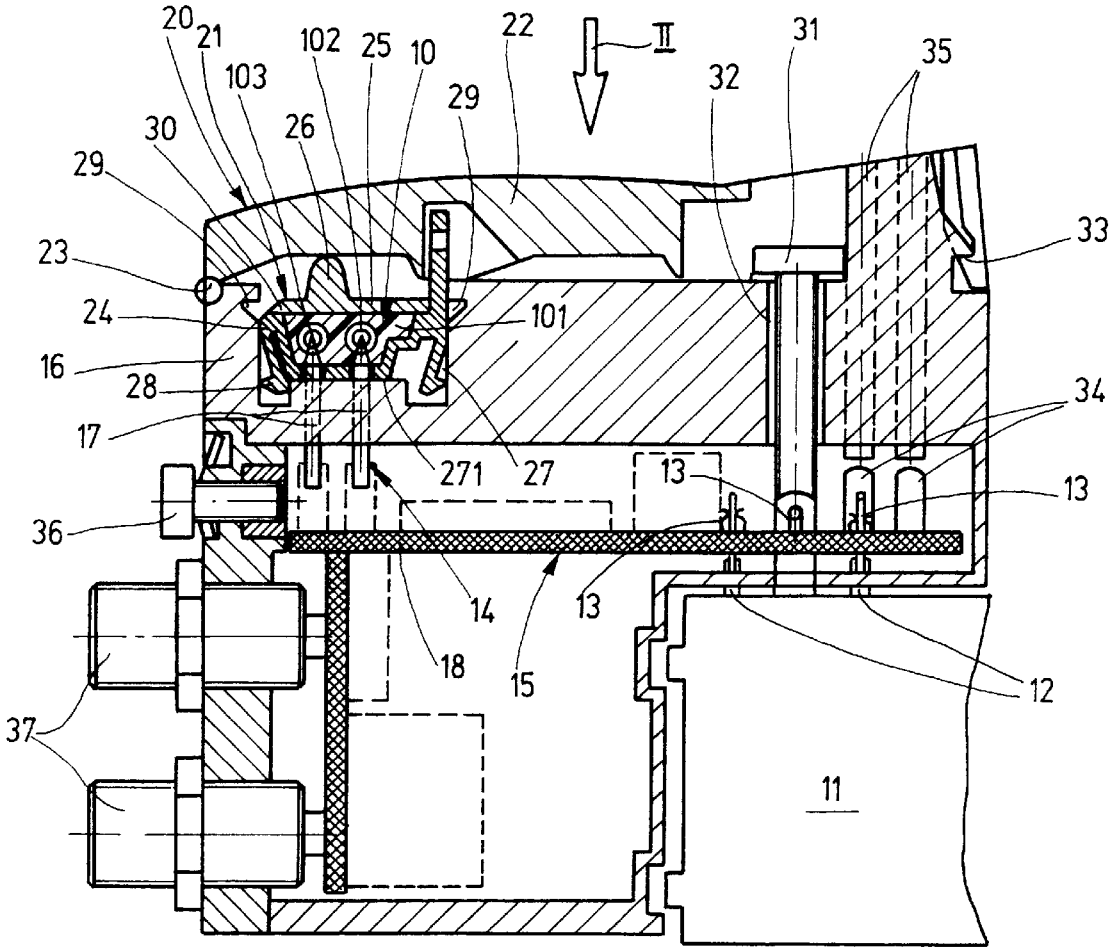
FIG. 1 is a view showing the longitudinal section of a plug for connection of an electro-fluidic converter.
Figure 2:
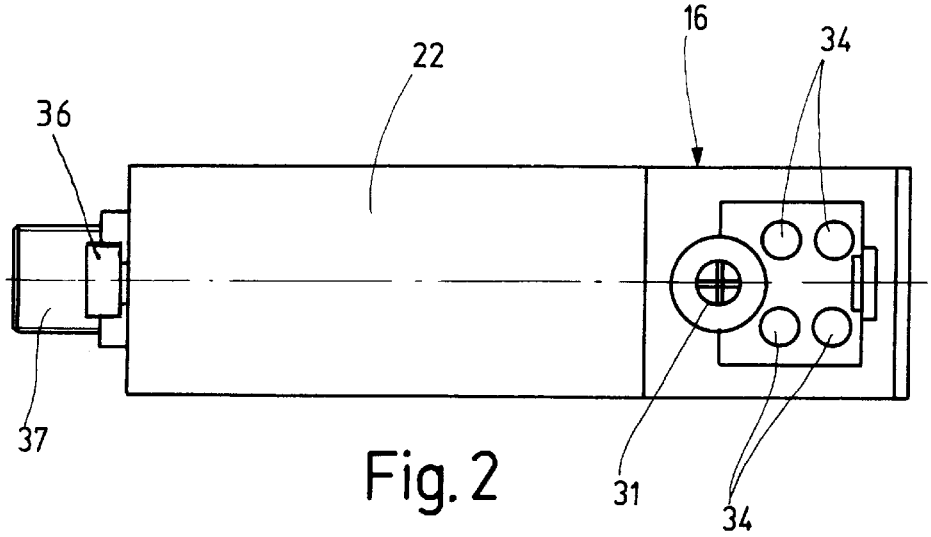
FIG. 2 is a plan view of the plug in accordance with the present invention as seen in direction of the arrow 2 in FIG. 1.

A plug shown in a longitudinal section in FIG. 1 and on a plan view in FIG. 2 is used for connecting an electrofluidic converter to a control conductor leading to a control unit and formed as an encased, two-wire cable 10. The fluid is converter converts an electric input signal into a fluidic pressure signal. It has an electrical input part and a pneumatic output part. The pneumatic output part is received in a converter housing 11 which is shown in a section in FIG. 1. For connection of the electrical inlet part to a central control unit, electrical plug contacts 12 project on the converter housing 11. The plug is plugged on them for producing the connection to the control unit.

The plug has counter contacts 13 for the converter plug contacts 12, connecting means 14 for the two-wire, encased connecting cable 10 and an electric or electronic connecting means for joining the connecting means 14 with the counter contacts 13. All these components are accommodated in a plug housing 16. The counter contacts 13, the connecting means 10 having the contact tips 17, and the connecting means 15 are arranged on a printed circuit card 18. The connecting means 18 serve on the one hand for current supply of the converter and on the other hand for transmission of control signals to the converter. They include, in addition to the conductor tracks formed on the printed circuit card 18, also electrical components such as a demodulator and a decoder which preferably are integrated in a chip. Furthermore, a contacting device 20 is provided in the plug housing 16 for connection with the connecting cable 10 of the connecting means 14 in the plug housing 16.

The contacting device 20 operates without tools. It has a movable receiving part 21 for insertion of a cable portion of the connecting cable 10, as well as a clamping lever 22 which acts on the cable receiving part 21 and is fixed on the plug housing 16 turnably about a turning axis 22. The cable receiving part 21 is injection molded of plastic and composed of two parts. It has an insertion trough 24 for a form-locking receipt of the encased connecting cable 10, and a cover 25 which is formed turnably movablely on the insertion trough 24 for closing the opening of the insertion trough 24. A centering projection 26 extends on the upper side of the cover 25. It cooperates with the clamping lever 22 and transmits the pressure force produced by the clamping lever 22 to the cable receiving part 21.

The cable receiving part 21 is inserted in a well 27 formed in the plug housing 16, with two diametrically arranged arresting projections 28 shown in FIG. 2 and engaging in arresting recesses 29 which are formed in the well wall 27. The arresting connection formed by the arresting projection 28 and the arresting recesses 29 is designed so that by an axial pressure force on the centering projections 26 on the cable receiving part 21, the arresting projections exit downwardly from the arresting openings 29 and thereby it is possible to displace the cable receiving part 21 in the well 27 in direction toward the well bottom 271. The contact tips 17 of the connecting means 14 extend outwardly of the well bottom 271. Throughgoing openings are arranged in the bottom of the insertion trough 24 of the cable receiving part 21 and are in alignment with the contact tips 17. Their diameter is greater than the outer diameter of the contact tips 17.

Figure 5:
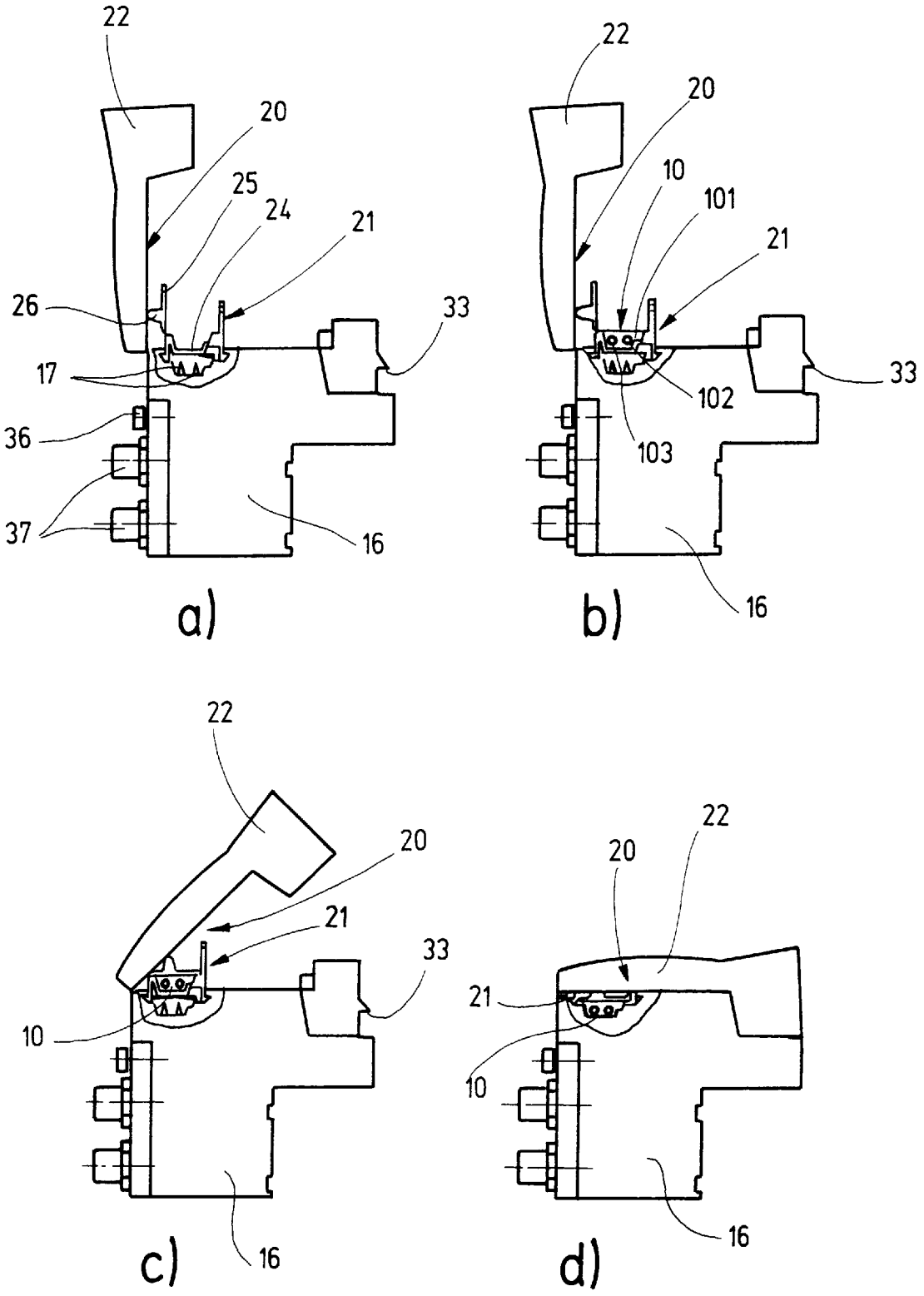
FIG. 5 is a side view of the plug of FIG. 1 at four various time points of the mounting.

After plugging of the plug with its countercontacts 13 on the converter plug contacts 20, the plug housing 16 is screwed by a single mounting screw 31 which extends through an opening 32 in the plug housing 16 and into a threaded hole in the converter housing 11. Then the connection of the plug to the connecting cable 10 by the contacting device 20 is performed as shown in FIG. 5.

When the clamping lever 22 is lifted, the cable receiving part 21 is accessible. The cover 25 and the insertion trough 24 are connected with one another so that the cover 25 is loaded with return force acting in the opening direction. When the clamping lever 22 is turned upwardly, the insertion trough 24 is released as shown in FIG. 5*a*, and the connecting cable 10 can be inserted into the insertion trough 24 as shown in FIG. 5*b*. Then the clamping lever 22 is turned in direction to the plug housing 16 as shown in FIG. 5*c*, whereby the lower side of the clamping lever 22 is placed on the centering projection 26 and during further turning of the clamping lever 22 applies an axial pressing force on the cable receiving part 21. Thereby the cable receiving part 21 is pressed out of the arresting openings 29 in the well 27 and displaced in direction toward the well bottom 271. The contacting tips 17 press through the throughgoing opening 30 in the well bottom 271, drill through the casing 101 of the connecting cable 10, and then drill into the cable wires 102 and 103 of the connecting cable 10 to provide there an electrical contact. Thereby the connecting means 14 are electrically contacted to the connecting cable 10, and through the connecting means 15 connect the counter contacts 13 and the converter plug contacts 12 of the converter to the connecting cable 10.

The clamping lever 22 is finally arrested with an arresting connection 33 to the cover housing 16, so that it is force-transmittingly fixed through the centering projection 26 of the cable receiving part 21 to the well bottom 271. The connecting cable 10 which is formed-lockingly inserted in the insertion trough 24 is firmly clamped by the cover 29 in the insertion trough 24, so that the connecting cable 10 is fixed also mechanically to the plug as shown in FIG. 5*d*. The connecting cable 10 leads to a central control element, from which the converter is selectively controlled by control signals. The light indicators arranged in the plug housing 16, such as for example diodes arranged on the printed circuit card 18, signal the switching condition of the converter by their illumination. The light indicators 34 are visible through a window 35 formed in the plug housing 16. Further details of the plug housing 16, such as for example a grounding screw 36 and an impact plug 37 for sensors are just marginally important.

Figure 3:
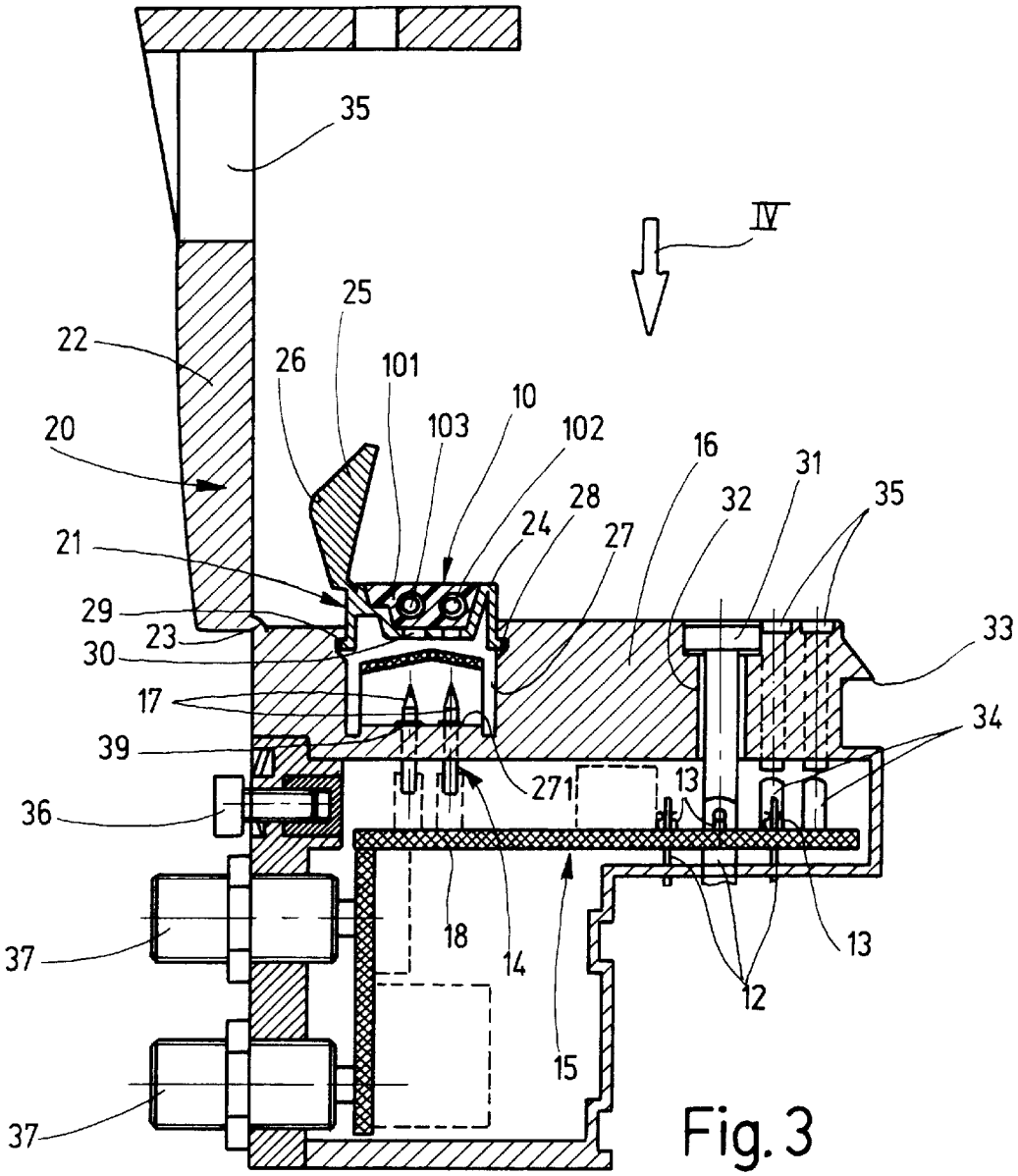
FIG. 3 is a view corresponding to the view of FIG. 1 but showing a modified plug in accordance with the present invention.

The plug shown in a longitudinal section in FIG. 3 differs from the above described plug substantially by a modification of the contacting device 20. The parts of this plug which coincide with the parts of the plug shown in FIGS. 1 and 2 are identified with the same reference numerals. FIG. 3 shows a plan view of the modified plug, with the clamping lever 22 articulately folded on the plug housing 16, and the cable receiving part 21 is removed from its arresting position in the shaft 27.

The connecting means 14 have four contact tips 17 which are connected through the connecting means 15 with the counter contacts 13 for two electrical inlet parts of the second converter arranged in the converter housing 11. The four contact tips 17 extend in the same way through the well bottom 271 in the well 27 and project with a distance over the well bottom 271. The bottom of the insertion trough 24 of the cable receiving part 21 is provided with four throughgoing openings 30 for contact tips 17 and for a slot for passage of a separating disk 38. The separating disk is arranged between two pairs of the contact tip 17 transversely to the extension direction of the connecting cable 10 vertically on the shaft bottom 271. The separating disk 38 is formed so that due to the process of turning of the clamping lever 22 to the plug housing 16 shown in FIG. 1, and thereby acting downward pressure of the cable receiving part 21 in direction to the well bottom 271, the connecting cable 10 can be separated. Therefore, in the cable receiving part 21, two cable portions which are separate from one another are electrically contacted with one another with isolation from one another and are mechanically firmly clamped.

Figure 4:
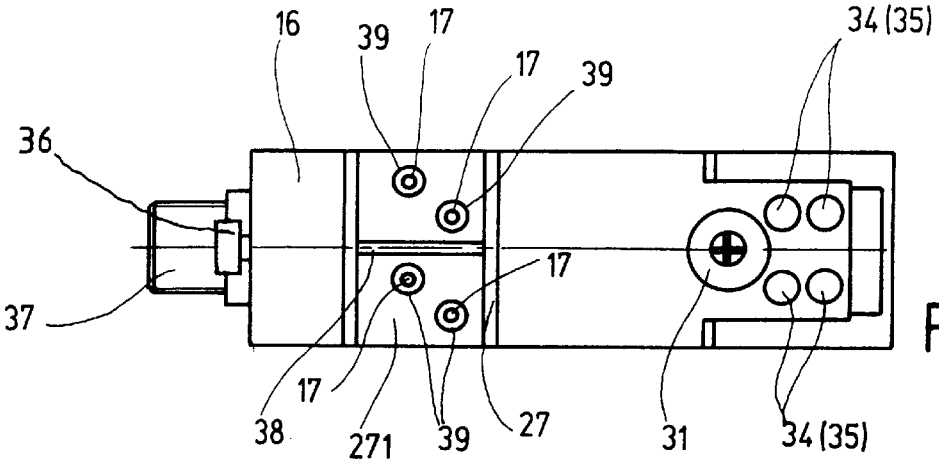
FIG. 4 is a plan view of the plug shown in FIG. 3 as seen in direction of the arrow 4.

FIG. 4 shows that a sealing contour 39 is arranged on each contact tip 17 which projects from the well bottom 271. It surrounds the associated contact tip 17 and together with the flexible cable insulation serves for sealing. During pressing of the connecting cable 10 into the contacting device 20 with separation of the connecting cable by the separating disk 38, the sealing ring 39 provides a fluid-tight connection between the plug housing 16 and the cover of the mutually separated cable portions, so that no moisture or no water can reach the contacting points of the contact tips 17 and cable wires 102, 103.

In a modification of the contacting device 20, the cable receiving part 21 is composed of two parts parallel to the separating disk 28. Therefore in the well 27 two identically formed cable guiding part portions are provided at the right side and at the left side of the separating disk 38. Each partial portion has a separate insertion trough 24 and a separate cover 25 with the centering projection 26 placed on it. This subdivision of the cable receiving part 21 into two parts has the advantage that both cable portions of the connecting cable 10 separated by the separating disk 38 can be released during the clamping process from the contacting device 20 indepegndently from one another.

It will be understood that each of the elements described above, or two or more together, may also find a useful application in other types of constructions differing from the types described above.

While the invention has been illustrated and described as embodied in plug for connection of an electro-fluidic converter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A plug for connection of an electro-fluidic converter provided with electrical plug contacts projecting from a converter housing, the plug comprising a plug housing; electrical counter contacts to said plug contacts of said converter and accommodated in said plug housing; electrical connecting means for a multi-wired cover connecting cable and accommodated in said plug housing; connecting means for electrical or electronic joining of said connecting means with said counter contacts and accommodated in said plug housing; and a contacting device provided for connecting said connecting cable with said connecting means and arranged in said plug housing, said contacting device having a movable cable receiving part for insertion of a cable portion and a clamping lever acting on said cable receiving part for contact-producing pressing of the cable portion against said connecting means, said contacting device being provided with a separating disk for separating an inserted portion of the connecting cable transversely to its longitudinal extension at least in a wire region of the connecting cable, said cable receiving part having a bottom provided with a slot formed so that when said clamping lever acts on said cable receiving part, said separating disk extends through said slot, said cable receiving part being separated into two part pieces which have an identical construction and are arranged at one side of said separating disk.

2. A plug as defined in claim 1, wherein said electrical connecting means have contact tips which pierce through a casing of the connecting cable and contacting cable wires extending in the connecting cable.

3. A plug as defined in claim 2, wherein said cable receiving part has a bottom provided with throughgoing openings for said contact tips.

4. A plug as defined in claim 2, wherein said plug housing has a well with a well bottom through which said contact tips extend, said cable receiving part being arranged in said well of said plug housing, said well having well walls provided with arresting recesses which are arranged at a distance from said well bottom, said cable receiving part having arresting projections engaging in said arresting recesses, said arresting recesses and said arresting projections forming an arresting connection which is formed so that an axial pressing force applied by said clamping lever to said clamping receiving part withdraws said arresting projections from said arresting recesses and releases said cable receiving part for displacement toward said well bottom.

5. A plug as defined in claim 4, wherein said cable receiving part and a depth of said well are determined relative to one another so that when said clamping lever is arrested, said cable receiving part is clamped on said well bottom in a force-transmitting and liquid-tight manner.

6. A plug as defined in claim 1, wherein said cable receiving part has a centering projection cooperating with said clamping part, said centering projection being formed so that said clamping lever during turning on said cable receiving part is placed on said projection.

7. A plug as defined in claim 1, wherein said clamping lever is turnably fixed on said plug housing and is arrestable on said plug housing in a turning end position in which it is folded on said plug housing.

8. A plug as defined in claim 1, wherein said contacting device is provided with a separating disk for separating an inserted portion of the connecting cable transversely to its longitudinal extension at least in a wire region of the connecting cable, said cable receiving part having a bottom provided with a slot formed so that when said clamping lever acts on said cable receiving part, said separating disk extends through said slot.

9. A plug as defined in claim 8, wherein said plug housing has a well with a well bottom, said separating disk being arranged in said well of said plug housing with a distance from said well bottom.

10. A plug as defined in claim 8, wherein said well has a well base; and further comprising sealing contours which surround said contact tips and are arranged on said well base to provide a liquid-tight connection between said contact tips and a casing of said connecting cable.

11. A plug as defined in claim 1, wherein said cable receiving part has two parts including an insertion trough and a cover which covers said insertion trough and is turnable from a trough opening.

12. A plug as defined in claim 11, wherein said insertion trough and said cover are formed together as a one-piece element composed of synthetic plastic.

13. A plug as defined in claim 1, wherein said plug housing has at least one light indicator for indicating a switching condition of the converter.

14. A plug as defined in claim 13, wherein said plug housing is provided with a window through which said light indicator is visible.

15. A plug as defined in claim 13, wherein said clamping lever is provided with a window through which said light indicator is visible.

16. A plug for connection of an electro-fluidic converter provided with electrical plug contacts projecting from a converter housing, the plug comprising a plug housing; electrical counter contacts to said plug contacts of said converter and accommodated in said plug housing; electrical connecting means for a multi-wired cover connecting cable and accommodated in said plug housing; connecting means for electrical or electronic joining of said connecting means with said counter contacts and accommodated in said plug housing; and a contacting device provided for connecting said connecting cable with said connecting means and arranged in said plug housing, said contacting device having a movable cable receiving part for insertion of a cable portion and a clamping lever acting on said cable receiving part for contact-producing pressing of the cable portion against said connecting means, said cable receiving part having two parts including an insertion trough and a cover which covers said insertion trough and is turnable from a trough opening, said cover having an outer side facing said clamping lever; and a centering projection arranged centrally on said outer side of said cover.

17. A plug as defined in claim 16, wherein said electrical connecting means have contact tips which pierce through a casing of the connecting cable and contacting cable wires extending in the connecting cable.

18. A plug as defined in claim 17, wherein said cable receiving part has a button provided with throughgoing openings for said contact tips.

19. A plug as defined in claim 17, wherein said plug housing has a well with a well bottom through which said contact tips extend, said cable receiving part being arranged in said well of said plug housing, said well having well walls provided with arresting openings which are arranged at a distance from said well bottom, said cable receiving part having arresting projections engaging in said arresting recesses, said arresting recesses and said arresting projections forming an arresting connection which is formed so that an axial pressing force applied by said clamping lever to said clamping receiving part withdraws said arresting projections from said arresting recesses and releases said cable receiving part for displacement toward said well bottom.

20. A plug as defined in claim 19, wherein said cable receiving part and a depth of a well are determined relative to one another so that when said clamping lever is arrested, said cable receiving part is clamped on said well body in a force-transmitting and liquid-tight manner.

21. A plug as defined in claim 16, wherein said cable receiving part has a center projection cooperating with said clamping part, said centering projection being formed so that said clamping lever during turning on said cable receiving part is placed on said projection.

22. A plug as defined in claim 16, wherein said clamping lever is turnably fixed on said plug housing and is arrestable on said plug housing in a turning end position in which it is folded on said plug housing.

23. A plug as defined in claim 16, wherein said contacting device is provided with a separating disk for separating an inserted portion for connecting cable transversely to its longitudinal extension at least in a wire region of its connecting cable, said cable receiving part having a bottom provided with a slot formed so that when said clamping lever acts on said cable receiving part, said separating disk extends through said slot.

24. A plug as defined in claim 23, wherein said plug housing has a well with a well bottom, said separating disk being arranged in said well of said plug housing with a distance from said well bottom.

25. A plug as defined in claim 23, wherein said well has a well base; and further comprising sealing contours which surround said contact tips and are arranged on said well base to provide a liquid-tight connection between said contact tips and a casing of said connecting cable.

26. A plug as defined in claim 23, wherein said cable receive plug is separated into two part pieces which have an identical construction and are arranged at one side of said separating disk.

27. A plug as defined in claim 16, wherein said insertion trough and said cover are formed together as a one-piece element composed of synthetic plastic.

28. A plug as defined in claim 16, wherein said plug housing has at least one light indicator for indicating a switching condition of the converter.

29. A plug as defined in claim 28, wherein said plug housing is provided with a window through which said light indicator is visible.

30. A plug as defined in claim 28, wherein said clamping lever is provided with a window through which said light indicator is visible.

* * * * *